US007409960B2

(12) United States Patent
Hoser et al.

(10) Patent No.: US 7,409,960 B2
(45) Date of Patent: Aug. 12, 2008

(54) CLEANING FLUID CONTAINER

(75) Inventors: Jurgen Hoser, Neu-Anspach (DE); Daniel Dietzel, Kelkheim (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/333,103

(22) Filed: Jan. 17, 2006

(65) Prior Publication Data

US 2006/0169306 A1 Aug. 3, 2006

Related U.S. Application Data

(63) Continuation of application No. PCT/EP2004/006197, filed on Jun. 9, 2004.

(30) Foreign Application Priority Data

Jul. 17, 2003 (DE) ..... 103 32 385

(51) Int. Cl.
*B08B 3/00* (2006.01)

(52) U.S. Cl. ..... 134/109; 134/110; 134/137; 134/138; 134/143; 134/155; 134/177; 134/182; 134/183; 134/186

(58) Field of Classification Search ..... 134/166 R, 134/137, 138, 143, 177, 178, 182, 183; 30/41.5
See application file for complete search history.

(56) References Cited

U.S. PATENT DOCUMENTS 3,634,935 A * 1/1972 Battigalli ..... 30/41.5
4,039,448 A * 8/1977 Etani ..... 210/702
4,911,190 A * 3/1990 Sheldon ..... 134/85
5,277,800 A 1/1994 Dieckmann et al.
5,582,743 A 12/1996 Larson et al.
6,874,514 B1 * 4/2005 Hoser et al. ..... 134/109

FOREIGN PATENT DOCUMENTS

| | | |
|---|---|---|
| DE | 42 06 425 | 9/1993 |
| DE | 44 02 237 | 3/1995 |
| DE | 44 17 815 | 10/1995 |
| DE | 199 18 287 | 2/2000 |
| DE | 199 37 167 | 3/2000 |
| DE | WO00/64300 | * 11/2000 |
| DE | 697 03 857 | 8/2001 |
| EP | 0 798 452 | 1/2001 |

* cited by examiner

*Primary Examiner*—Michael Barr
*Assistant Examiner*—Rita R Patel
(74) *Attorney, Agent, or Firm*—Fish & Richardson P.C.

(57) ABSTRACT

The invention aims at improving a cleaning fluid container (3) for a cleaning device (RV) for personal needs, in particular for cleaning a shaving head (SK) of a dry shaving apparatus (R), with a housing (20), with an inlet port (15) provided on the housing (20) to admit cleaning fluid (11), with an outlet port (14) equally provided on the housing (20) to discharge the cleaning fluid (11), and with a filter element (F), said filter element (F) being provided with filter pores for filtering out solid particles, particularly hair particles, and being arranged in a flow area between the inlet port (15) and the outlet port (14), in a manner enabling the pump capacity to be significantly reduced or the service life of a cartridge (K) to be substantially increased. This is accomplished in that the filter element (F) has pores of a size causing part of the particles to penetrate the filter element (F) according to their size.

19 Claims, 3 Drawing Sheets

CLEANING FLUID CONTAINER

CROSS-REFERENCE TO RELATED APPLICATIONS

This is a continuation of PCT Application No. PCT/EP2004/006197, filed on Jun. 9, 2004, which claims priority to German Patent Application No. 103 32 385.6, filed on Jul. 17, 2003, which is incorporated herein by reference in its entirety.

TECHNICAL FIELD

This invention relates to a cleaning device for the shaving head of a shaving apparatus, particularly a cleaning fluid container.

BACKGROUND

A cleaning fluid container of this type is known from DE 199 18 287 C1. This cleaning fluid container has at its outlet port a very fine-mesh filter element. The filter element intercepts all particles, such as hair and skin particles, which do not settle along a sedimentation path in the cleaning fluid container, in order to prevent them from entering a pump assembly. However, particularly after a certain number of cleaning cycles, the filter element may become clogged under circumstances. This requires the use of a relatively high pump capacity to prevent a reduction of the flow rate by the clogged filter element. A diminished pump jet means that a cleaning well receiving a shaving head is filled incompletely and at too slow a rate. This deteriorates the cleaning action of the cleaning device materially. Furthermore, the fluid jet then fails to clean thoroughly the area behind the outer cutter of the shaving head, meaning the interior of the shaving head.

To enable a pump with a reduced capacity to be used it would be necessary to exchange the cleaning fluid container, which is in the form of a cartridge, more frequently, which is however not desirable in respect of the utilization factor of the fluid volume.

The present invention is based on the realization that particularly small particles, in particular suspended particles, which essentially are made up of skin particles, are responsible for the clogging of a filter element. According to the invention, these relatively small particles are allowed to pass through the filter element. The small particles allowed to pass are of a size enabling a fine filter fabric or the like to be dispensed with in the area of the outlet port. These relatively small particles can be circulated through the pump without damaging it.

Retrofitting a cleaning device is a particularly simple task since the filter element heretofore used can be simply omitted, using the cleaning fluid container of the invention.

Furthermore, shavers with a sharp undercutter may be employed—without appreciably degrading cleaning performance. These shavers may produce a higher content of skin particles in the hair dust.

Large particles, such as relatively long beard hairs, are entrapped on the large-pore filter of the invention and hence prevented from reaching the pump. These relatively large particles will not clog the filter element, not even if the cleaning device is used particularly frequently without replacing the cleaning fluid container. Accordingly, the service life of the cleaning fluid container of the invention is particularly long.

SUMMARY

According to one embodiment, the pores of the filter element are of a nature causing small particles, which pass through the filter element along with the cleaning fluid, to be merely slowed down in the filter element. This provision has the effect on the one hand that this open-pore construction does not slow down or impede the fluid stream, and on the other hand that the velocity of the particles in the fluid stream is reduced, thereby enabling a high degree of sedimentation to be attained. In addition, the filter element provides for a uniform distribution of these small particles, in particular the skin particles.

In a further aspect of the cleaning fluid container of the invention, provision is made for the filter element to be constructed as a brick-shaped member integrated in the interior space of the housing. This affords ease of assembly and accommodation of the filter element in the housing. By virtue of the brick-shaped or right parallelepipedal form, the pores of the filter element are distributed spatially, that is, three-dimensionally.

Using preferably plastic foam as filter material, the desired filter characteristic can be obtained in a very economical way. The plastic foam part which, by its very nature, has open cells, possesses an optimal filter function for filtering out longer hairs. A long filter life with a low pump capacity is therefore possible. Furthermore, plastic foam is a material easy to work or cut to size. It is elastic and can therefore be sandwiched between existing walls, bars or the like of the housing, being thereby held in frictional and/or positive engagement therewith. Structural changes to the housing shape or tool modifications for the manufacture of a new housing are therefore not necessary.

It has shown to be particularly suitable for the pores of the filter element to be of a size enabling particles smaller than 0.1 mm, in particular skin particles, to pass through the filter element. This ensures an optimum filter performance in respect of hair and skin particles. While large or long hair particles cannot penetrate the pores, very small particles, that is, smaller than 0.1 mm, in particular skin particles, can be flushed through the filter element due to the continual fluid stream during the cleaning cycle. On account of the pore arrangement, particularly on account of the three-dimensional pore arrangement, they are however slowed down severely and can be intercepted along a sedimentation path, at the latest after several cleaning or pump cycles, so that they, too, ultimately remain in the cleaning fluid container as harmless sediment. In contrast to the use of known fabric filters, the large-pore design of the filter element of the invention enables a significantly reduced pump capacity to be used. Hair particles as, for example, shaved off beard hairs, are as a rule much bigger or longer than 0.1 mm and therefore unable to pass through the filter element.

According to another embodiment of the invention, the interior space of the cleaning fluid container includes at least in some areas a sedimentation path for the particles from the cleaning fluid to settle. By such sedimentation a large part of the solids or particles is separated from the cleaning fluid, settling along the path. Part of the solids does not even reach the filter element. Another part of the solids, namely small particles, may even sediment immediately after having passed through the filter element if the filter element is arranged, for example, midway along the sedimentation path.

To enhance the flow characteristic of the cleaning fluid and achieve sedimentation in a compartment in close proximity to the inlet port, the filter element is preferably located on the sedimentation path leading from the inlet port to the outlet port, particularly at a location about midway along the sedimentation path, with the filter element in particular being located in the area of a wall element forming two compartments. By shifting the sedimentation to the first compartment, the useful life of the cleaning fluid container or a cartridge is appreciably extended. In particular the wall element terminates at a predetermined distance to a transverse wall of the housing, with the filter element being arranged in an opening formed by the wall element and the transverse wall. Preferably, ribbed or honeycomb structures or both are provided along the sedimentation path in a side area and/or in a bottom area of the housing. Preferably, honeycomb structures are provided in the bottom area only.

In another aspect, the cleaning fluid container allows part of the particles penetrates the filter element according to their size. In another aspect, the cleaning fluid container the pores of the filter element are of a nature causing small particles, which pass through the filter element along with the cleaning fluid, to be merely slowed down in the filter element. In another aspect, the filter element is constructed as a brick-shaped, in particular right-parallelepipedal member integrated in the interior space) of the housing In another aspect, the filter element is a plastic-foam part In another aspect, the pores of the filter element are of a size enabling particles smaller than 0.1 mm, in particular skin particles, to pass through the filter element. In another aspect, the interior space of the cleaning fluid container includes at least in some areas a sedimentation path for settling out of the particles from the cleaning fluid In another aspect, the filter element is located on the sedimentation path leading from the inlet port to the outlet port in particular in the transition region between a first compartment serving as inlet chamber and a second compartment serving as aspiration chamber, preferably at a location about midway along the sedimentation path. In another aspect, the filter element is located in the area of a wall element separating the two compartments In another aspect, the filter element is arranged between the wall element and a transverse wall of the housing being in particular clampingly held. In another aspect, the wall element terminates at a predetermined distance to a transverse wall of the housing with the filter element being arranged in an opening formed by the wall element and the transverse wall In another aspect, ribbed or honeycomb structures or both are provided along the sedimentation path, in particular in an area of a housing bottom wall and/or on longitudinal walls of the housing In another aspect, particle separation is essentially by sedimentation, in particular attaining nearly 100%. In another aspect, the outlet port is constructed as an area devoid of a filter, in particular devoid of a fabric filter. In another aspect, the cleaning fluid container is constructed as a replaceable cartridge.

Generally, in a further embodiment, a system includes a dry shaving apparatus and a cleaning station. The cleaning station further includes a cleaning device; a holding device a fluid impelling assembly for the cleaning fluid a cleaning well and a cleaning fluid container. The cleaning fluid container further includes a housing, an inlet port provided on the housing to admit cleaning fluid an outlet port equally provided on the housing to discharge the cleaning fluid and a filter element having a three-dimensional pore structure between the inlet port and the outlet port for filtering out solid particles.

DETAILED DESCRIPTION

Figure 1:
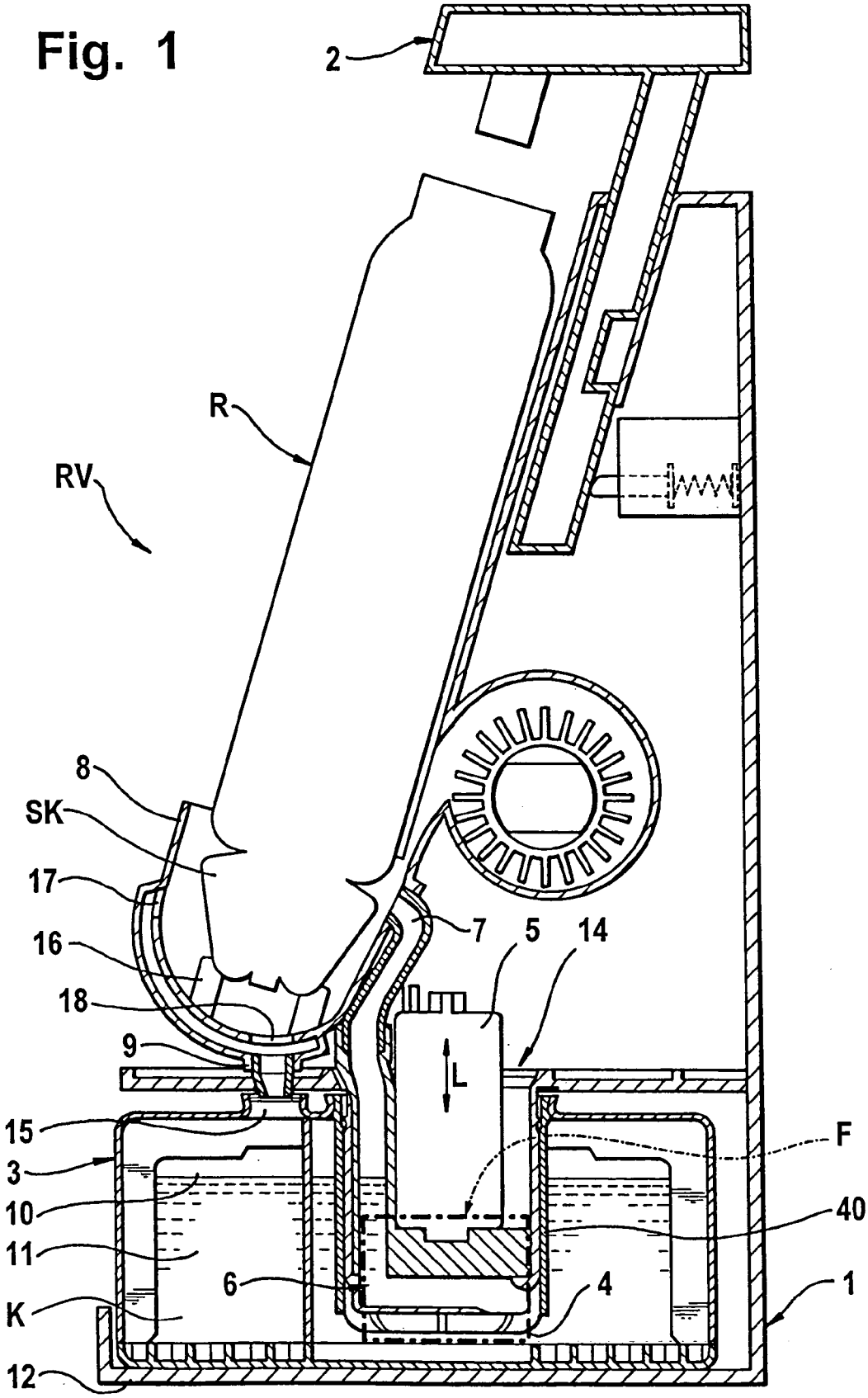
FIG. 1 is a longitudinal sectional view of a cleaning device with a replaceable cleaning fluid container of the invention, showing a filter element only in phantom lines.

FIG. 1 shows a cleaning device RV for cleaning a shaving head SK of a shaving apparatus R, in particular a dry shaving apparatus. Conveniently, the cleaning device is constructed as a station in which the shaving apparatus R can be parked and also recharged electrically. The cleaning device RV comprises a station housing 1, a holding device 2, a long-life cleaning fluid container 3 of the invention, a fluid impelling assembly 6 for pumping a cleaning fluid 11 essentially composed of an alcoholic solution, a supply conduit 7 leading to a cleaning well 8 having a drain 18 above a wall 12, a fluid discharge port 9 as well as a filter element F of the invention, subsequently described in detail.

The fluid impelling assembly 6 is provided with an electric motor 5. It is housed in an interior space 10 of the invention cleaning fluid container 3 of the cleaning device RV and designed to slide out of this interior space 10 (see arrow L), so that the cleaning fluid container 3 is readily removable from one side of the cleaning device RV to be replaced with a new cleaning fluid container 3. The cleaning fluid container 3 is preferably constructed as a disposable cartridge K having the filter element 4 integrated in the cartridge K. This affords the advantage of having a fresh filter element F available on each replacement of the cartridge K, which does not degrade the pump capacity of the fluid impelling assembly 6 and the cleaning effect of the cleaning device.

The cleaning well 8 has an inner curvature shaped to conform approximately to the outer contour of the shaving head SK. The cleaning well 8 receives as much cleaning fluid as is necessary for the respective cleaning cycle. However, the level of cleaning fluid must always be such as to encompass a major part of the shaving head SK to accomplish a good cleaning operation. It is therefore important for the pump circuit to be not adversely affected as could be the case in the event of a filter element becoming clogged by particles such as skin and hair particles or by the formation of a filter cake, or an inadequate pump or inadequate fluid impelling assembly 6.

Furthermore, the cleaning device RV comprises supporting elements 16 for the shaving head SK and an overflow device 17.

To produce a consistently good cleaning action, the present invention provides that the filter element F has pores of a size enabling part of the particles to pass through the filter element F according to their size. The small particles could otherwise clog a filter element, which is constructed as a fine filter fabric, as early as after about 15 cleaning cycles, such that the fluid level in the cleaning well 8 would drop. This means that the inflow of cleaning fluid through the supply conduit 7 could not compensate for the outflow through the fluid discharge port 9.

With the provision of the invention, the cleaning quality of the cleaning device RV is independent of skin and hair type and shaving habits.

Figure 2:
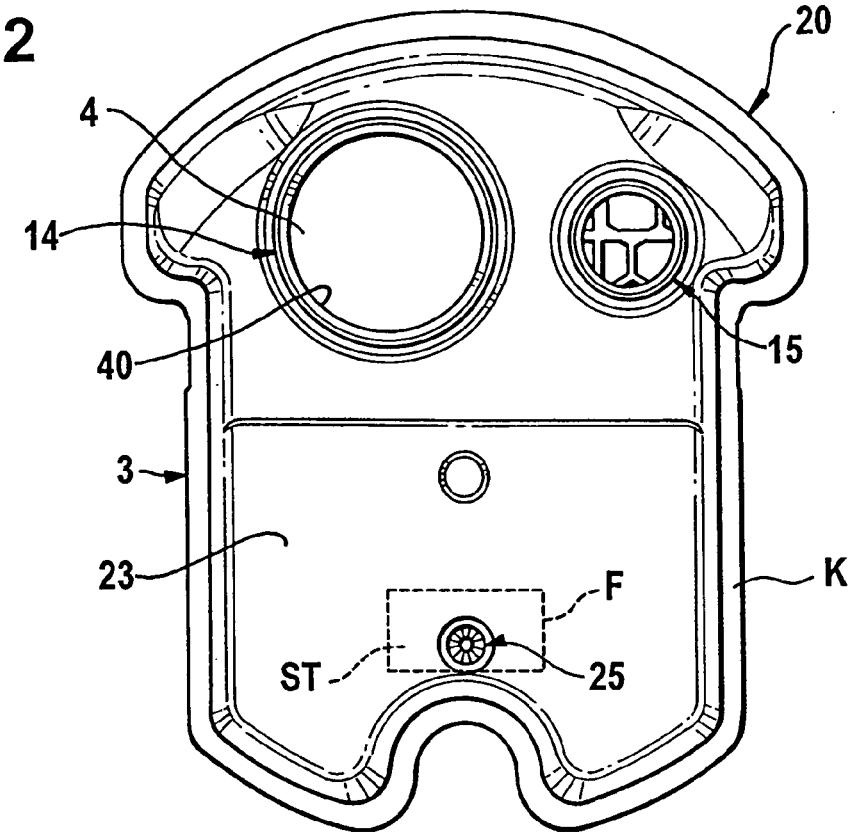
FIG. 2 is a view of the top of an upper housing wall of the cleaning fluid container of the invention with an inlet and an outlet port, with the filter element in the housing being indicated by broken lines.
Figure 3:
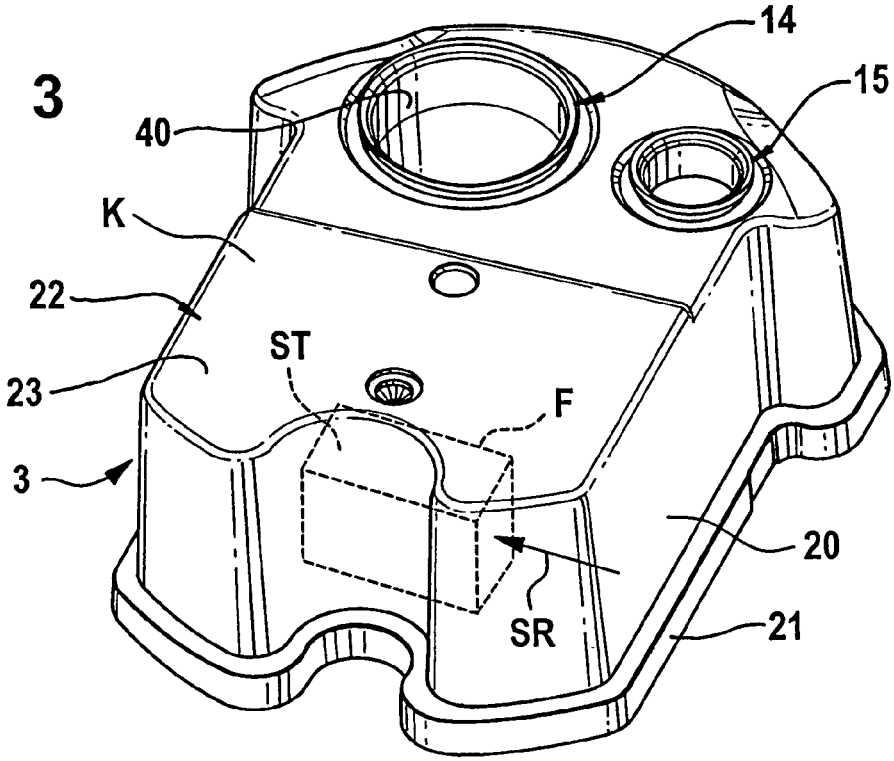
FIG. 3 is a perspective view of the cleaning fluid container showing the filter element in broken lines.
Figure 4:
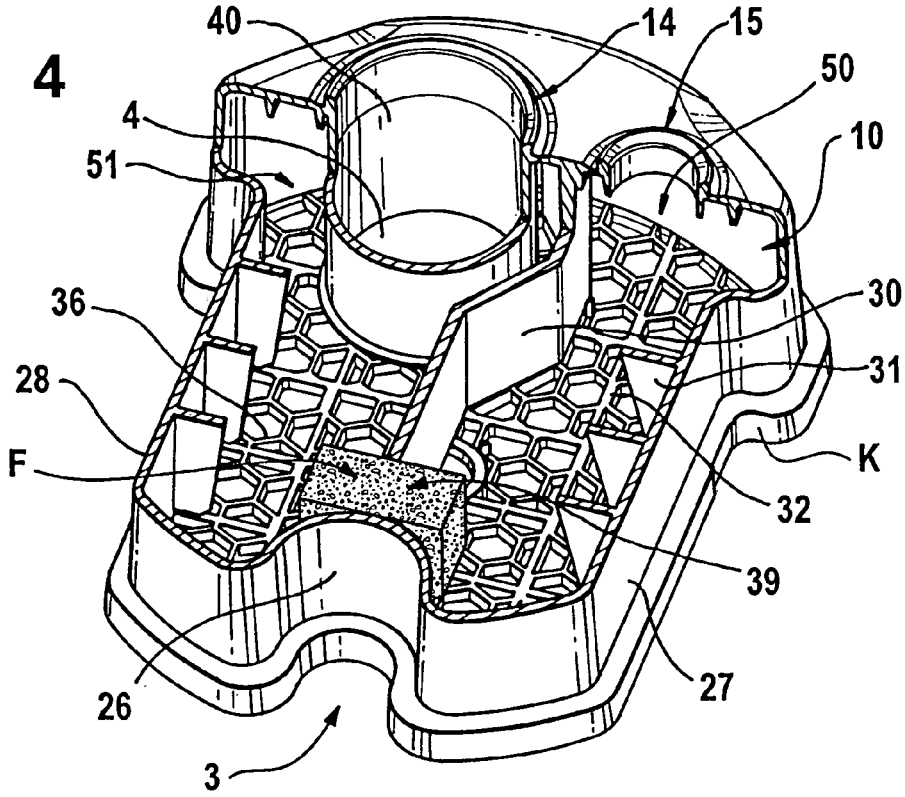
FIG. 4 is a perspective view of the cleaning fluid container of FIG. 3 with a part-sectional view of the upper housing wall, two longitudinal walls, a transverse wall connecting these and of a wall element, with the filter element being likewise shown schematically.

FIGS. 2 to 4 show the cleaning fluid container 3 in a preferred embodiment.

FIG. 2 shows a view of an upper housing wall 23 of a housing 20 of the cleaning fluid container 3. Arranged in the housing wall 23 preferably adjacent to each other are an inlet port 15 and an outlet port 14. Furthermore provided is a filling orifice 25 for filling the cleaning fluid container 3 with cleaning fluid 11 which is done in the manufacture of the cartridge with the inlet port 15 closed with a closure member and the outlet port 14 likewise closed. The filling orifice 25 is adapted to be closed with a plug.

Adjoining the outlet port 14 is a circumferentially closed, cylindrical wall 40. The wall 40 extends to a point short of a bottom, which is in particular structured, as becomes apparent from FIG. 4. In proximity to the bottom, the wall 40 is adjoined by an open area preferably devoid of a filter. However, this area may also be provided with a fastening structure for a fabric filter (for example, a filter casing). The fabric filter is however not installed. This enables the continued use of production tools as heretofore employed in the manufacture of housings for cleaning fluid containers with fabric-type filter elements. The filter arrangement subsequently described keeps the area underneath the cylindrical wall 40 or the fluid impelling assembly 6 free from solid sediments.

On the opposite side of the ports 14 and 15 (transverse wall 26) is a plastic-foam part ST representing the filter element F. The cleaning fluid 11 flows from the inlet port 15 past a wall element 30 (FIG. 4 and FIG. 5) through the plastic-foam part ST or the filter element F (see arrow SR) and again past the wall element 30 and back to the outlet port 14. This lengthened path encourages sedimentation.

The pores of the plastic-foam part ST are of a nature allowing the passage of small particles, in particular skin particles encountered in the hair dust, through the plastic-foam part ST along with the cleaning fluid 11. It is in particular by reason of the spatial filter structure in which the three-dimensional pores propagate in several directions in the manner of a sponge that these small particles are slowed down appreciably, which in combination with a sedimentation path to be described later is highly advantageous.

The plastic-foam part ST possesses pores dimensioned to enable particles smaller than 0.1 mm, in particular skin particles, to pass through it. Thus it cannot become clogged by them.

As shown in FIG. 3, the plastic-foam part ST acting as filter element 4 is preferably a brick-shaped, in particular right-parallelepipedal, part and integrated in the interior space 10 of the housing 20. In the direction of flow SR the plastic-foam part ST is of a length greater than its height and width defining the flow cross-section. The path through the filter is thereby lengthened, which on the one hand reduces the particle speed and simplifies part location in the interior of the housing 20. The part may be fixed flat in the bottom area. For example, the length of the plastic-foam part ST amounts to about one third of the length of an adjacent transverse side or a transverse wall 26 of the housing 20. Its width is, for example, about half its length, and its height, for example, amounts to half its width.

The pore size amounts to about 1 to 3 mm, in particular 1.65 to 2.15 mm. The pore shape is irregular. The pores compare to those of a typical household sponge, for example. Preferably, the filter element has a gross weight of about 20 to 30, in particular 23 to 27 kg/m$^3$ and is alcohol-resistant. The cell density is advantageously in the neighborhood of 20-35 ppi.

The plastic-foam part ST can be easily cut to length from a roll of foam strips or cut out of a foam mat, hence affording economy of manufacture.

In an advantageous further aspect of the invention, in the interior space of the cleaning fluid container 3 provision is made for a sedimentation path for the settling out of particles from the cleaning fluid 11.

The plastic-foam part ST is preferably arranged on or within this sedimentation path, dividing it into two sections. The sedimentation within the two path sections differs. In particular, the majority of the solids settles in the first section, while the suspended particles continue being entrained in the fluid flow.

The sedimentation path is of an approximately U-shaped configuration and extends preferably about the wall element 30 dividing the cleaning fluid container 3 into two compartments 50, 51. The plastic-foam part ST is located in particular in the transition region between the first compartment 50 associated with the inlet port 15 and the second compartment 51 associated with the outlet port 14. The first compartment 50 serves as inflow chamber, while the second compartment 51 serves as aspiration chamber. The plastic-foam part ST is arranged at a location about halfway along the sedimentation path. By reason of this filter arrangement, sedimentation is shifted to the first compartment 50, thereby extending the service life of the cleaning fluid container 3 constructed as a cartridge. As mentioned in the foregoing, there is practically no sedimentation taking place underneath the fluid impelling assembly 6.

Advantageously, the wall element 30 terminates at a predetermined distance to the housing's transverse wall 26 on the side close to the filter, with the plastic-foam part ST being arranged in an opening 39 defined by the wall element 30 and the transverse wall 26, preferably being held clamped there. The wall element 30 may be part of a cup-shaped part 22 of the housing 20. The plastic-foam part ST closes the opening 30 preferably completely on all sides.

Figure 5:
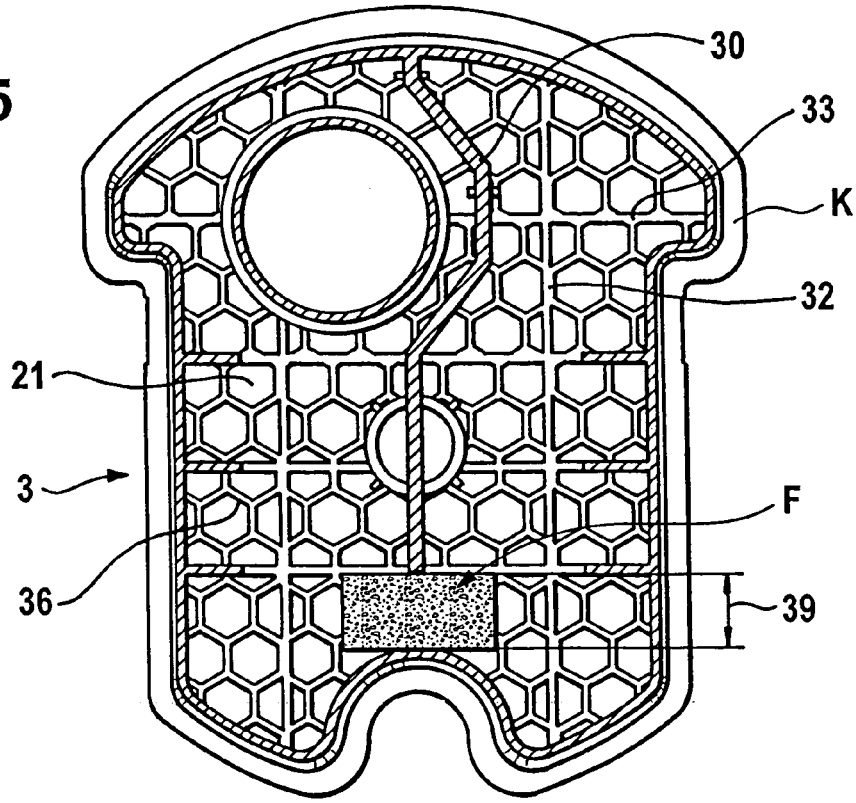
FIG. 5 is a view of one side of the housing bottom wall provided with a honeycomb structure, longitudinal bars, and the filter element.

As illustrated in FIGS. 4 and 5, to promote the sedimentation of solids, inwardly extending ribs 31 are suitably formed on longitudinal walls 27, 28 of the housing 20, and/or ribbed and/or honeycomb structures 32, 33, 36 are formed on a bottom wall 21 of the housing 20.

With the provisions described, particle separation by sedimentation attains nearly 100%. Only a very small percentage of the solids, particularly the larger particles, is entrapped on the plastic-foam part ST.

Furthermore, the cleaning fluid container 3 may be equipped with a fluid level indicator. In contrast to the known cleaning fluid container, the improved cleaning characteristic prevents the occurrence of an inadequate cleaning action because of a clogged filter element upstream of the pump although the cartridge is full (fluid level indicator=full). With the known device, the shaving apparatus was occasionally cleaned only to a highly inadequate degree under clogged filter conditions, in spite of a fluid level indicator reading "FULL".

It will be understood that the present invention is not limited to the embodiment described but may also find application in other cleaning fluid containers. For instance, the wall element 30 may be constructed as an overflow device. Furthermore, provision may be made for additional filters having pore properties differing from those herein described. The additional filters may operate in combination with the filter element of the invention.

The present invention also covers a filter element F which does not close the opening 39 over its full height, thereby causing the filter element F to form an overflow, for example.

Large, heavy particles will be entrapped by the filter element F at the latest, while light, suspended particles can be carried away over the filter element, entrained by the current flowing in part over the filter element F. This variant contributes to reducing the flow resistance still further.

What is claimed is:

1. A cleaning fluid container for a cleaning device for personal needs, in particular for cleaning a shaving head of a dry shaving apparatus comprising:

a housing;

an inlet port provided on the housing to admit cleaning fluid;

an outlet port provided on the housing to discharge cleaning fluid; and a filter element of open cell foam disposed between the inlet port and the outlet port and configured to filter out solid hair stubble particles while passing skin particles entrained in the fluid.

2. The cleaning fluid container according to claim 1 wherein the filter element is sized to block particles larger than 0.1 mm and allow passage of particles smaller than 0.1 mm.

3. The cleaning fluid container according to claim 1 wherein cells of the filter element are of a nature causing small particles, which pass through the filter element along with the cleaning fluid, to be merely slowed down in the filter element.

4. The cleaning fluid container according to claim 1 wherein the filter element has a pore size of between 1.65-2.15 mm and a cell density of between 20-35 pores per inch.

5. The cleaning fluid container according to claim 1 wherein the filter element is secured in position within the housing by friction.

6. The cleaning fluid container according to claim 1 wherein cells of the filter element are of a size enabling particles smaller than 0.1 mm in particular skin particles, to pass through the filter element.

7. The cleaning fluid container according to claim 1 wherein the interior space of the cleaning fluid container includes at least in some areas a sedimentation path for settling out of the particles from the cleaning fluid.

8. The cleaning fluid container according to claim 7 wherein the filter element is located on the sedimentation path leading from the inlet port to the outlet port in particular in the transition region between a first compartment serving as inlet chamber and a second compartment serving as aspiration chamber, preferably at a location about midway along the sedimentation path.

9. The cleaning fluid container according to claim 8 wherein the filter element is located in the area of a wall element separating the two compartments.

10. The cleaning fluid container according to claim 9 wherein the filter element is arranged between the wall element and a transverse wall of the housing being in particular clampingly held.

11. The cleaning fluid container according to claim 9 wherein the wall element terminates at a predetermined distance to a transverse wall of the housing with the filter element being arranged in an opening formed by the wall element and the transverse wall.

12. The cleaning fluid container according to claim 10 wherein the wall element terminates at a predetermined distance to a transverse wall of the housing with the filter element being arranged in an opening formed by the wall element and the transverse wall.

13. The cleaning fluid container according to claim 7, characterized in that ribbed or honeycomb structures or both are provided along the sedimentation path, in particular in an area of a housing bottom wall and/or on longitudinal walls of the housing.

14. The cleaning fluid container according to claim 7 wherein particle separation is essentially by sedimentation, in particular attaining nearly 100%.

15. The cleaning fluid container according to claim 1 wherein the outlet port is constructed as an area devoid of a filter, in particular devoid of a fabric filter.

16. The cleaning fluid container according to claim 1 wherein the cleaning fluid container is constructed as a replaceable cartridge.

17. A system comprising:

a dry shaving apparatus and a cleaning station further comprising:

a cleaning device;

a holding device for holding the dry shaving apparatus;

a fluid impelling assembly for moving the cleaning fluid;

a cleaning well for holding the cleaning fluid in contact with the dry shave apparatus; and a cleaning fluid container further comprising:

a housing;

an inlet port provided on the housing to admit cleaning fluid;

an outlet port equally provided on the housing to discharge the cleaning fluid: and a filter element having an open cell foam structure between the inlet port and the outlet port and configured to filter out solid hair stubble particles while passing skin particles entrained in the fluid.

18. The system according to claim 17, wherein the filter element is sized to block particles larger than 0.1 mm and allow passage of particles smaller than 0.1 mm.

19. The system according to claim 17, wherein the flier element has a pore size of between 1.65-2.15 mm and a cell density of between 20-35 pores per inch.

* * * * *

UNITED STATES PATENT AND TRADEMARK OFFICE

CERTIFICATE OF CORRECTION

PATENT NO. : 7,409,960 B2
APPLICATION NO. : 11/333103
DATED : August 12, 2008
INVENTOR(S) : Jurgen Hoser It is certified that error appears in the above-identified patent and that said Letters Patent is hereby corrected as shown below:

Column 7, Claim 1, Line 15:
After "discharge" Insert -- the --

Column 7, Claim 6, Line 39:
After "mm" Insert -- , --

Column 8, Claim 17, Line 43:
Delete "fluid:" and Insert -- fluid; --

Column 8, Claim 19, Line 51:
Delete "flier" and Insert -- filter --

Signed and Sealed this

Fourth Day of November, 2008

JON W. DUDAS
*Director of the United States Patent and Trademark Office*